United States Patent [19]

Pettersson

[11] Patent Number: 4,484,887

[45] Date of Patent: Nov. 27, 1984

[54] DEVICE IN BURNERS

[75] Inventor: Sune Ö Pettersson, Kalix, Sweden

[73] Assignee: AB Allterm, Kalix, Sweden

[21] Appl. No.: 568,935

[22] PCT Filed: Nov. 21, 1980

[86] PCT No.: PCT/SE80/00296

§ 371 Date: Jul. 23, 1981

§ 102(e) Date: Jul. 23, 1981

[87] PCT Pub. No.: WO81/01604

PCT Pub. Date: Jun. 11, 1981

Related U.S. Application Data

[63] Continuation of Ser. No. 287,756, Jul. 23, 1981, abandoned.

[30] Foreign Application Priority Data

Nov. 29, 1979 [SE] Sweden ..... 790986

[51] Int. Cl.[3] ..... F23Q 3/00

[52] U.S. Cl. ..... 431/265; 431/186; 431/351; 239/406

[58] Field of Search ..... 431/183, 186, 189, 265, 431/351, 353, 350; 239/403, 404, 406, 420, 424

[56] References Cited

U.S. PATENT DOCUMENTS

| | | | |
|---|---|---|---|
| 2,156,121 | 4/1939 | Macrae | 239/406 |
| 2,634,806 | 4/1953 | Hirtz | 239/406 |
| 3,361,365 | 1/1968 | Dysart et al. | 431/265 |
| 3,733,169 | 5/1973 | Lefebvre | 431/265 |
| 3,799,733 | 3/1974 | Tickell, Sr. | 431/350 |
| 4,338,076 | 7/1982 | Straumann et al. | 431/351 |

FOREIGN PATENT DOCUMENTS

| | | | |
|---|---|---|---|
| 2704884 | 8/1978 | Fed. Rep. of Germany | 431/265 |
| 1332961 | 6/1963 | France | 431/265 |
| WO79/00468 | 7/1979 | PCT Int'l Appl. . | |
| 399471 | 2/1978 | Sweden . | |
| 168969 | 5/1934 | Switzerland . | |
| 575573 | 5/1976 | Switzerland . | |
| 902860 | 7/1958 | United Kingdom | 431/265 |

*Primary Examiner*—Margaret A. Focarino

*Attorney, Agent, or Firm*—Dowell & Dowell

[57] ABSTRACT

Devices in burners, for examples oil burners, with a feed tube (12) and a burner retainer (13,15) inserted into the same. The air stream in the feed tube is made to be affected by a retarding shield (20) positioned ahead of the burner retainer (13,15) and having a central aperture for the flame and a substantially circularly surrounding gap (18) between the retarding shield (20) and the inner periphery of the feed tube, and by a flange (19) extending rectangularly inwards from said inner periphery and which is positioned in spaced relation to the retarding shield in the direction of flow of the air.

4 Claims, 2 Drawing Figures

DEVICE IN BURNERS

This application is a continuation of application Ser. No. 287,756, filed 7/23/81, now abandoned.

The present invention relates to a device in burners, for example oil burners, of that kind which comprises a feed tube projecting into a heating boiler, for example, as well as a burner retainer inserted into the feed tube.

In connecting with burners of the kind stated above it is known to arrange guide elements in the feed tube which exercise an effect on the air stream in the tube in order to control the appearance of the flame of the burner. Thus it is known, for example, to arrange a guide device for the air which consists of inclined fins designed to impart to the combustion air a turbulent movement such as to cause it to intermix with the fuel from the nozzle of the burner retainer.

It is also known to arrange a turbulator in the feed tube having conically widening fore and rear ends and a cylindrical portion which is formed with turbulator fins in order to impart desired turbulency to the air stream. In conjunction with the latter arrangement it has been proposed also to direct a secondary air stream inwards towards the centre of the feed tube. In a known burner this problem has been solved by applying a row of holes guiding the secondary air, whereas according to another proposal there is used a turbulator with turbulator fins and comprising an annular element positioned in the direction of flow of the air behind the turbulator, which element has the shape of a frustrated cone with an angle of inclination directed against the direction of flow of the air stream.

All known devices have the drawback that the composition of the guide element or turbulator with fins and auxilliary members as well as the mounting thereof in the burner retainer becomes complicated.

The main object of the present invention is to provide a simple and uncomplicated device for affecting the air stream in desired direction and/or to initiate turbulency in the air stream, and according to a further object the device shall also be easy to adjust after installation in the burner retainer. These and other objects of the invention are attained by the device having been given the characteristic features stated in the subsequent claims.

In the following the invention will be described in conjunction with an embodiment which is shown in the drawings.

Figure 1:
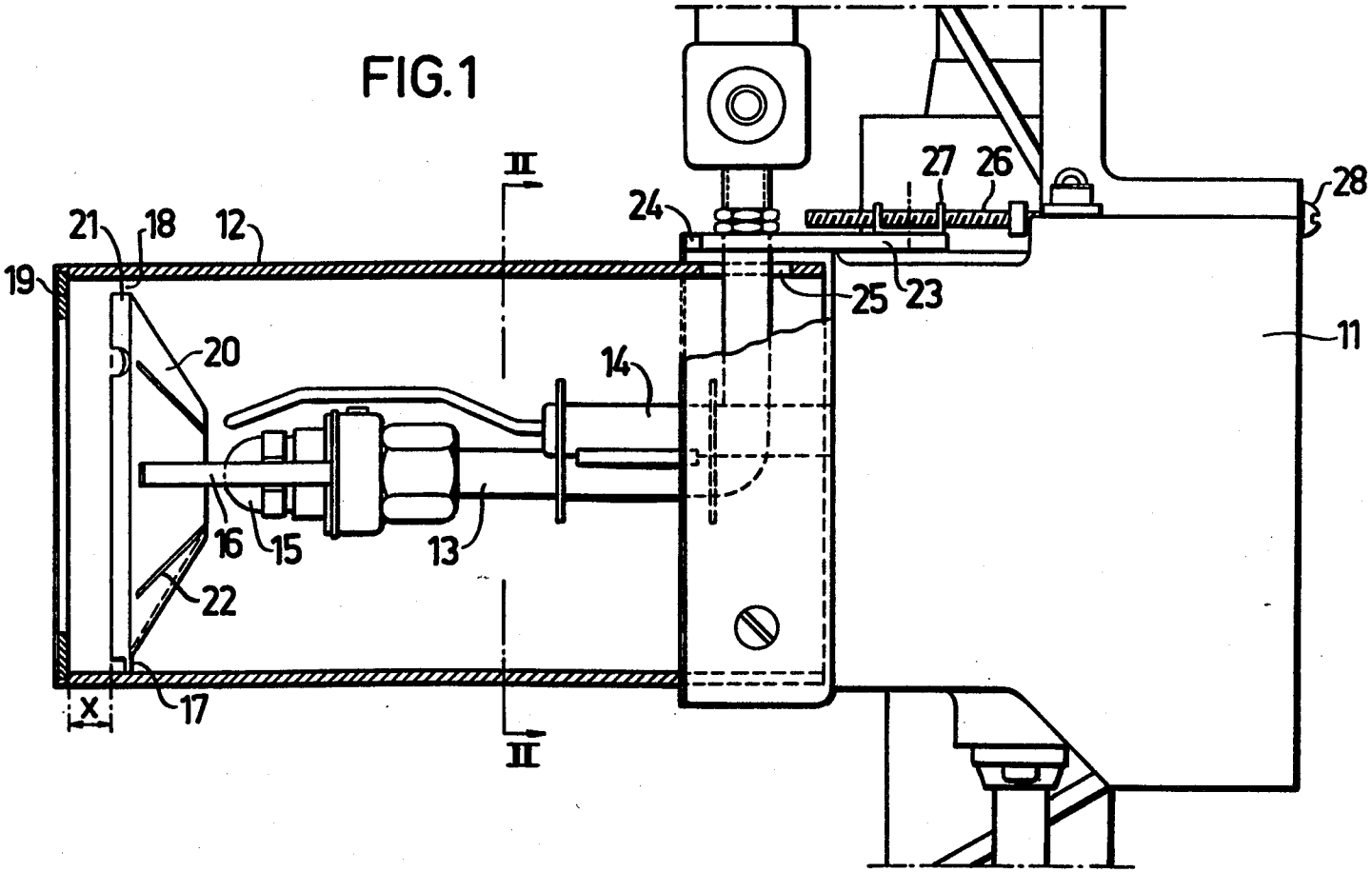
FIG. 1 shows diagrammatically a longitudinal section through a burner, such as an oil burner, in which a guide device according to the invention has been installed.

The burner according to the invention comprises a feed tube 12, which is devised to be inserted into the combustion chamber in a heating boiler or the like. Disposed at the rear end of the feed tube 12, in the figure the right-hand end, is a casing 11 which supports the members necessary for the operation of the burner such as motor, impeller, fuel supply etc., which are not shown or denoted.

Disposed in the feed tube 12 is in normal manner a burner retainer, which comprises a nozzle 15 and a fuel pipe 13 which is connected with the nozzle 15 by means of a screw connection not designated. The fuel pipe 13 carries also ignition electrodes 14 for ignition of the flame of the burner.

According to the invention, there is disposed ahead of the nozzle 15 a retarding shield 20 which is supported by the nozzle 15 by a means of two arms 16. In its centre the retarding shield 20 has an opening not denoted for the jet of fuel ejected from the nozzle and the cover surface of the retarding shield is increasing conically in the direction of flow of the air stream and terminates with an annular portion 21 from which e.g. three laps or lugs 17 are punched out and constitute centering heads for the retarding shield by abutment against the inside of the feed tube. Thus there remains between the retarding shield 20 and the inside of the feed tube an air gap 18 between the centering heads 17. Secured to, according to the drawing, left-hand outer end of the feed tube 12 is according to the invention furthermore an annular flange 19 which projects rectangularly from the inner surface of the feed tube and the interior diameter of which is less than the outer diameter of the retarding shield adjacent the air gap 18. In addition the retarding shield 20 is formed with slots 22 arranged on the conical cover surface to bring about passage of air in the region for the slots 22.

Figure 2:
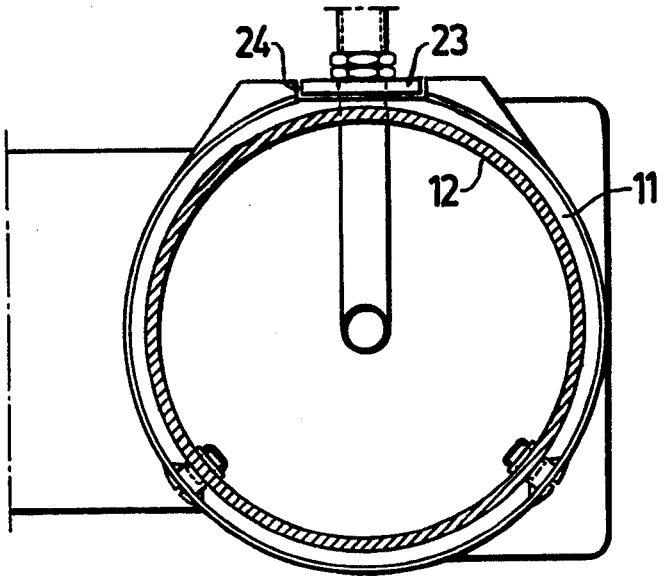
FIG. 2 shows a section following the line II—II of FIG. 1.

As is shown by dash-dotted lines the fuel pipe 13 is at its rear end bent rectangularly upwards and guided to the rear end of the feed tube 12 and fixed to a plate 23, which plate 23 is displaceable in a groove 24 (FIG. 2) in the top part of the casing 11. To permit displacement of the fuel pipe 13 and therewith that of the burner retainer, the clearance for the oil pipe in the feed tube 12 is formed as an elongated slot 25. When the plate 23 with the fuel pipe 13 is displaced forwards and backwards in the groove 24 the retarding shield 20 will thus also become displaced in the feed tube. The displacement is accomplished in the shown embodiment by means of a screw 26 which is carried in the casing 11 and is in engagement with threaded holes in a U-shaped bracket 27 mounted on the plate 23. In this connection the screw 26 may be mounted in an aperture extending from end to end in the casing 11 so that the adjustment may be effected by means of a screw head 28 positioned at the rear part of the casing.

As is evident from the aforesaid, the combustion air admitted from the rear end of the feed tube 12 will in usual manner partly pass through the centre of the retarding shield and through the slots 22 formed in the cover surface of the retarding shield, while another portion of the air enters into and passes through the annular gap 18 between the retarding shield and the feed tube 12. This portion of the air is guided thereafter by the annular rectangular flange 19 inwards towards the centre of the burner flame and brings about a constricted middle portion of the burner flame and surrounds the same, which has proved to render excellent combustion results. The spacing X between the annular end portion 21 of the retarding shield 20 and the flange 19 shall suitably be kept between 1–30 mms and preferably 2–15 mms for obtaining best combustion results with oil burners of normal size.

This adjustment offers possibility to change the appearance of the flame and to adapt the shape of the flame to large or small combustion chambers (fire boxes) and renders also high $CO^2$-contents in the combustion of the oil.

In advanced position of the burner retainer a larger quantity of air passes through the centre of the retarding shield and renders a great and long flame. To obtain a minor flame the retarding shield together with the retainer is drawn backwards, whereby the distribution of the air is changed and a minor quantity thereof passes through the centre.

I claim:

1. In a burner apparatus for oil burners which includes a feed tube having an inner surface and an end, a burner retainer including a fuel feed pipe and a nozzle connected thereto disposed within the feed tube, the improvement comprising, annular flange means mounted to the end of the feed tube, said flange means being rectangular in cross section and extending perpendicularly inwardly of the feed tube from the inner surface thereof and defining a generally axially oriented opening into the feed tube, shield means disposed within the feed tube between said flange means and the nozzle, means for adjustably mounting said shield means in the feed tube so as to permit the axial spacing between said shield means and flange means to be varied, said shield means having a generally central opening through which a flame from the nozzle can extend and an outer peripheral portion, means for orienting said shield means within the feed tube so that said outer peripheral portion of said shield means is spaced from the inner surface of the feed tube so as to provide a generally circular air gap therebetween, said flange means extending inwardly of said peripheral portion of said shield whereby air passing between said shield means and the inner surface of the feed tube is directed by said flange means perpendicularly toward the axis of the feed tube adjacent said axial opening so as to act to constrict any flame extending through said opening.

2. The apparatus of claim 1 in which said axial spacing between said shield means and said flange means is adjustable within a range of between 1 to 30 mms.

3. The invention of claim 2 in which said axial spacing is adjustable within a range of between 2 and 15 mms.

4. The apparatus of claim 1 in which said means for orienting said shield means within the feed tube includes a plurality of lug means integrally formed with and extending from said peripheral portion of said shield means, said lug means abutting the inner surface of the feed tube.

* * * * *